US010400432B2

(12) United States Patent
Fangmeier

(10) Patent No.: US 10,400,432 B2
(45) Date of Patent: Sep. 3, 2019

(54) SANITARY COUPLING

(71) Applicant: Neoperl GmbH, Mullheim (DE)

(72) Inventor: Martin Fangmeier, Auggen (DE)

(73) Assignee: Neoperl GmbH, Müllheim (DE)

( * ) Notice: Subject to any disclaimer, the term of this patent is extended or adjusted under 35 U.S.C. 154(b) by 0 days.

(21) Appl. No.: 15/573,262

(22) PCT Filed: May 24, 2016

(86) PCT No.: PCT/EP2016/000858
§ 371 (c)(1),
(2) Date: Nov. 10, 2017

(87) PCT Pub. No.: WO2017/005336
PCT Pub. Date: Jan. 12, 2017

(65) Prior Publication Data

US 2018/0135281 A1 May 17, 2018

(30) Foreign Application Priority Data

Jul. 7, 2015 (DE) ..... 20 2015 004 825 U

(51) Int. Cl.
*E03C 1/02* (2006.01)
*E03C 1/084* (2006.01)
*B05B 7/04* (2006.01)

(52) U.S. Cl.
CPC ..... *E03C 1/084* (2013.01); *B05B 7/0425* (2013.01); *E03C 1/02* (2013.01)

(58) Field of Classification Search
CPC ... E03C 1/084; E03C 1/02; E03C 1/08; B05B 7/0425; B05B 7/0416; B01F 3/0446
(Continued)

(56) References Cited

U.S. PATENT DOCUMENTS 4,474,207 A 10/1984 Rosenberg
5,409,066 A * 4/1995 McHugh ..... A62C 35/68 169/16
(Continued)

FOREIGN PATENT DOCUMENTS

DE 102014002175 5/2015
EP 2756878 7/2014
(Continued)

*Primary Examiner* — Arthur O. Hall
*Assistant Examiner* — Tuongminh N Pham
(74) *Attorney, Agent, or Firm* — Volpe and Koenig, P.C.

(57) ABSTRACT

A sanitary coupling (1) is provided that connects an inflow-side and an outflow-side line section to each other. A sanitary insert element (5) is provided that has an insert housing (4) and is insertable via an end-side insert opening into a housing receptacle (7) of a first line section (2). The housing interior (6) of the insert housing (4) communicates with the ambient air, in that an annular zone (10) is provided between the housing outer circumference of the insert housing (4) and the inner circumference of the housing receptacle (7), and in a partial region of said annular zone (10), at least one air duct (12) which is effective between housing interior (6) and housing outer circumference is provided. The first line section (2) has at least one air slot (13) which is open toward the end circumferential edge (9) and towards the inner circumference and towards the outer circumference of the first line section (2), and in the partial region of the annular zone (10) that is arranged between the annular flange (8) and the at least one annular seal (11), an air gap (14) is arranged between the housing outer circumference and the inner circumference of the housing receptacle (7), which air gap connects the air duct (12) to the air slot (13).

9 Claims, 4 Drawing Sheets

(58) Field of Classification Search
USPC ..... 239/428.5, 419.5, 571
See application file for complete search history.

(56) References Cited

U.S. PATENT DOCUMENTS

| | | | | |
|---|---|---|---|---|
| 2009/0090793 | A1 | 4/2009 | Ichige | |
| 2012/0138839 | A1* | 6/2012 | Fangmeier | G05D 7/016 251/356 |
| 2012/0248221 | A1 | 10/2012 | Onuki | |

FOREIGN PATENT DOCUMENTS

| | | |
|---|---|---|
| GB | 2464779 | 5/2010 |
| KR | 2020090007829 | 1/2010 |
| WO | 2011007983 | 1/2011 |

* cited by examiner

SANITARY COUPLING

BACKGROUND

The present invention relates to a sanitary coupling which connects an inflow-side and an outflow-side line section to each other, with a sanitary insert element which has an insert housing designed as an insert cartridge, which insert housing is inserted via an end-side insert opening into a housing receptacle in a first line section until an annular flange, which serves as an insert stop, on the insert housing acts upon an end circumferential edge of the first line section, said end circumferential edge bounding the insert opening, wherein the insert housing has a housing interior which communicates with the ambient air, wherein an annular zone is provided between the housing outer circumference of the insert housing and the inner circumference of the housing receptacle, said annular zone, in a partial region, having at least one air duct which is effective between the housing interior and the housing outer circumference, and wherein an air gap between the housing outer circumference and the inner circumference of the housing receptacle is arranged in the partial region of the annular zone, which partial region is arranged between the annular flange and the at least one annular seal.

Such sanitary couplings which connect two line sections to each other are already known in various embodiments. Such sanitary couplings are used, for example, in order to connect a hand-held shower or similar point of water consumption, on the one hand, to a water connection, on the other hand. In this case, one line section, and in particular the outflow-side line section, can have a housing receptacle which is generally designed as a cross-sectional extension of the clear through flow cross section and into which an insert housing designated as an insert cartridge is insertable until an annular flange, which serves as an insert stop, on the insert housing acts upon an end circumferential edge of the first line section, said end circumferential edge bounding the insert opening. If pressure is intended to be equalized in the housing interior of the insert housing or if ambient air is intended to be sucked into the housing interior and mixed there, for example, with the water flowing therethrough, the housing interior should be connected to the ambient air and at the same time care should also be taken to ensure a liquid-tight connection of the two line sections.

EP 2 756 878 A1 discloses a sanitary coupling which connects a hand-held shower to an inflow-side flexible shower hose. At its end facing the shower hose, the hand-held shower has a housing receptacle into which an inert element which serves as a jet aerator is insertable. Ventilation openings are provided in the insert housing of the previously known insert element, via which ventilation openings ambient air can be sucked into the housing interior and is supplied via the screw connection between the hand-held shower and the adjacent shower hose. However, the air conduction in the previously known sanitary coupling is guided via narrow gaps, which can have a limiting effect on the supply of air.

US 2012/248221 A1 already discloses a sanitary coupling of the type mentioned at the beginning which connects an inflow-side first line section and an outflow-side second line section to each other. The sanitary coupling which is designed as a water-saving unit and, to this end, is intended to enrich the water flowing therethrough with ambient air has an inflow-side first coupling part and an outflow-side second coupling part which are connected releasably to each other. The inflow-side first coupling part, which serves at the same time as an insert housing for a filter sieve, is inserted with an inflow-side coupling-part section via an end-side insert opening into a housing receptacle in the inflow-side first line section and is secured therein via a screw connection provided between the coupling part and the line section. In this case, an annular flange, which serves as an insert stop, on the insert housing acts upon the end circumferential edge bounding the insert opening of the first line section. The inflow-side coupling part has an outflow-side coupling-part section which protrudes in the manner of a pin over the first coupling-part section and opens in the outflow-side line section. In the partial region arranged between its coupling-part sections, the inflow-side first coupling part has radially oriented ventilation ducts, in each of which a non-return valve is provided. These ventilation ducts connect an annular zone, which remains between the coupling parts, to the liquid-conducting housing interior of the inflow-side first coupling part, wherein an outflow of the water flowing through the coupling part is prevented by the non-return valves. By the water flowing through the previously known coupling, ambient air is sucked in the manner of a water jet pump via the ventilation ducts into the liquid-conducting housing interior of the sanitary coupling and mixed there with the water flowing therethrough.

SUMMARY

It is the object to provide a sanitary coupling of the type mentioned at the beginning which permits as unobstructed communication as possible between an insert element arranged in the region of the hose coupling, on the one hand, and the ambient air, on the other hand, without the tightness of the said hose coupling thereby being impaired.

This object is achieved according to the invention in the case of the sanitary coupling of the type mentioned at the beginning in particular in that the housing interior of the insert housing is changeable in volume and communicates with the ambient air, in order to bring about pressure equalization in the volume-changeable housing interior of the insert housing, in that the first line section having the housing receptacle has at least one air slot which is open towards the end circumferential edge and towards the inner and towards the outer circumference of the first line section, and in that, the air gap connects the at least one air duct to the at least one air slot.

The sanitary coupling according to the invention is provided for connecting an inflow-side and an outflow-side line section to each other. In this case, the coupling according to the invention is assigned a sanitary insert element which has an insert housing designed as an insert cartridge. The insert housing, the housing interior of which is changeable in volume and, for this purpose, is intended to communicate with the ambient air, in order to bring about pressure equalisation in the volume-changeable housing interior of the insert housing is insertable via an end-side insert opening into a housing receptacle in a first line section, wherein said first line section can be the inflow-side or, better, the outflow-side line section. The insert housing is insertable into said first line section until an annular flange, which serves as an insert stop, on the insert housing acts upon an end circumferential edge of the first line section, said end circumferential edge bounding the insert opening. An annular zone is provided between the housing outer circumference of the insert housing and the inner circumference of the housing receptacle. In a partial region of said annular zone, at least one air duct is provided which is effective between the housing interior and the housing outer circumference.

The first line section having the housing receptacle has at least one air slot which is designed to be open towards the end circumferential edge bounding the insert opening and towards the inner circumference and towards the outer circumference of the first line section. Furthermore, an air gap is arranged in the partial region between the housing outer circumference and the inner circumference of the housing receptacle, which air gap connects the at least one air duct to the at least one air slot. The ambient air can therefore communicate with the housing interior of the insert housing via the at least one air slot and the at least one air duct and the air gap provided therebetween. Since the air duct and the air slot are connected via the air gap which is oriented in the circumferential direction, a particular alignment of insert element and of the first line section having the housing receptacle is not required. A secure and fixed connection of the line sections is not impaired although the ambient air can readily communicate via the air duct, the air gap and the air slot.

So that the housing interior of the insert housing can communicate with the ambient air, it is expedient if the annular zone provided between the housing outer circumference of the insert housing and the inner circumference of the housing receptacle is sealed radially by at least one annular seal.

It is particularly advantageous in this case if the annular seal is arranged at a distance from the annular flange, wherein that partial region of the annular zone which has the air duct effective between housing interior and housing outer circumference is preferably arranged between the annular flange and the at least one annular seal.

In order to be able to radially seal the annular zone between the housing outer circumference and the inner circumference of the housing receptacle, a lip seal or else a sealing bead can be provided on the outer circumference of the insert housing. However, in a particularly simple and advantageous embodiment according to the invention, the at least one annular seal is designed as a sealing ring which is held in a holding groove on the housing outer circumference of the insert housing.

In a particularly simple and advantageous development according to the invention, in which the annular flange can be arranged at that end of the insert element which faces the adjacent line portion, the second line section is sealed axially in relation to the annular flange.

It is expedient in this respect if a sealing ring is provided between the annular flange and the adjacent end circumferential edge of the second line section.

In order to be able to connect the two line sections to each other securely and fixedly and nevertheless releasably, it is advantageous if the inflow-side and the outflow-side line section are connected to each other by a screw connection or a bayonet connection.

If the line sections are connected to each other via a screw connection, it is provided in a preferred embodiment according to the invention that an external thread is provided on the outer circumferential side on the one line section, which external thread interacts with an internal thread in a union nut, which union nut is held rotatably on the other line section, but axially immovably at least in the direction of the external thread.

A particularly advantageous development according to the invention that substantially assists the communication of the housing interior with the ambient air makes provision for the air slot to merge into a longitudinal groove on the outer circumference of the first line section, which longitudinal groove passes in the axial direction through the external thread. It is advantageous here if the longitudinal groove extends over the end circumferential edge of the union nut, which end circumferential edge faces away from the adjacent line section.

In addition or instead, it can be advantageous if the longitudinal groove extends over the entire longitudinal extent of the external thread and preferably goes beyond the thread pitch facing away from the end circumferential edge of the first line section.

In a preferred embodiment according to the invention, the external thread is provided on the first line section, and the union nut is held rotatably on the second line section.

An embodiment is preferred here, in which the first line section is the outflow-side line section and the second line section is the inflow-side line section.

In a particularly simple and easily producible embodiment according to the invention, the air gap is formed by an annular groove, by a recess or by an annular gap on the housing outer circumference of the insert housing and/or on the inner circumference of the housing receptacle of the first line portion.

BRIEF DESCRIPTION OF THE DRAWINGS

Developments according to the invention emerge from the claims in conjunction with the drawing and the description of the figures. The invention is described in more detail below with reference to a preferred exemplary embodiment.

In the drawings.

DETAILED DESCRIPTION OF THE PREFERRED EMBODIMENTS

Figure 2:
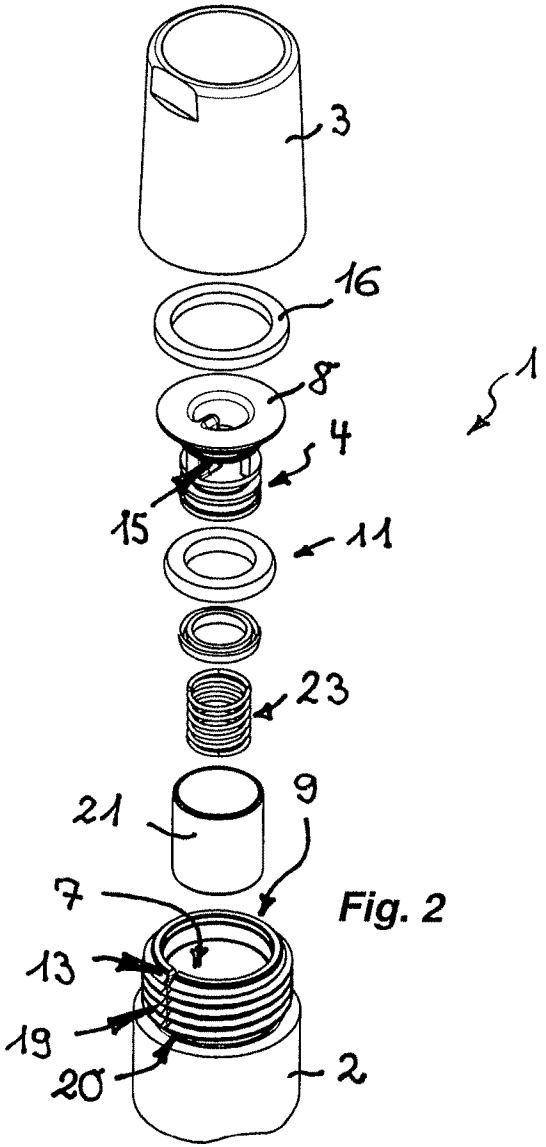
FIG. 2 shows the components of the sanitary coupling that are shown in FIG. 1, in a pulled-apart illustration of the individual parts of the first line section and of the insert element inserted therein.
Figure 1:
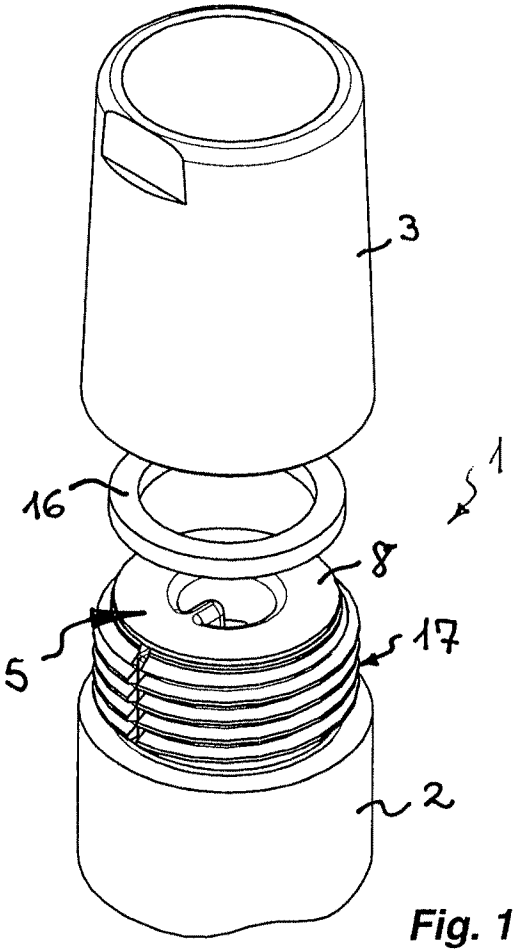
FIG. 1 shows a sanitary coupling which is shown in a perspective view of individual components and connect a first line section to a second line section (not shown further here), wherein the sanitary coupling also comprises a sanitary insert element which has an insert housing which is designed as an insert cartridge and is insertable via an end-side insert opening into a housing receptacle in the first line section until an annular flange, which serves as an insert stop, on the insert housing acts upon an end circumferential edge of the first line section, said end circumferential edge bounding the insert opening.
Figure 3:
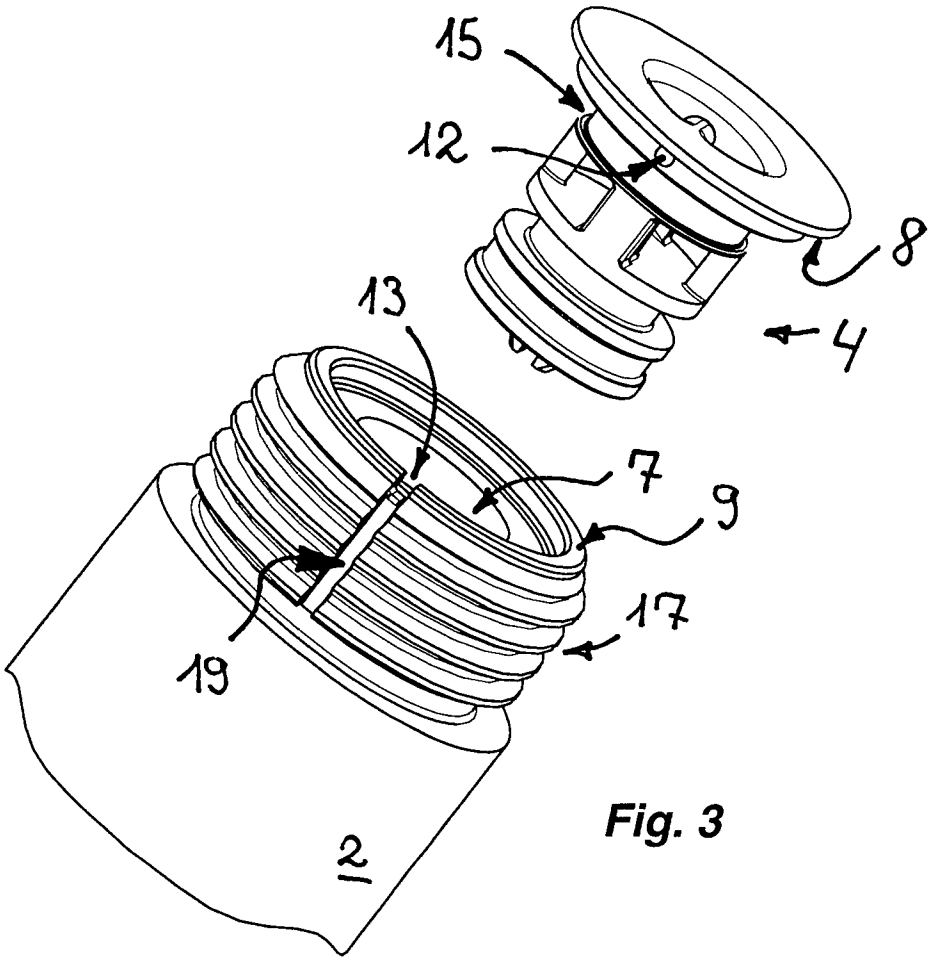
FIG. 3 shows the first line section with its end-side insert opening before insertion of the likewise illustrated insert element into the housing receptacle of said first line section.
Figures 4, 5, 6, 7, 8:
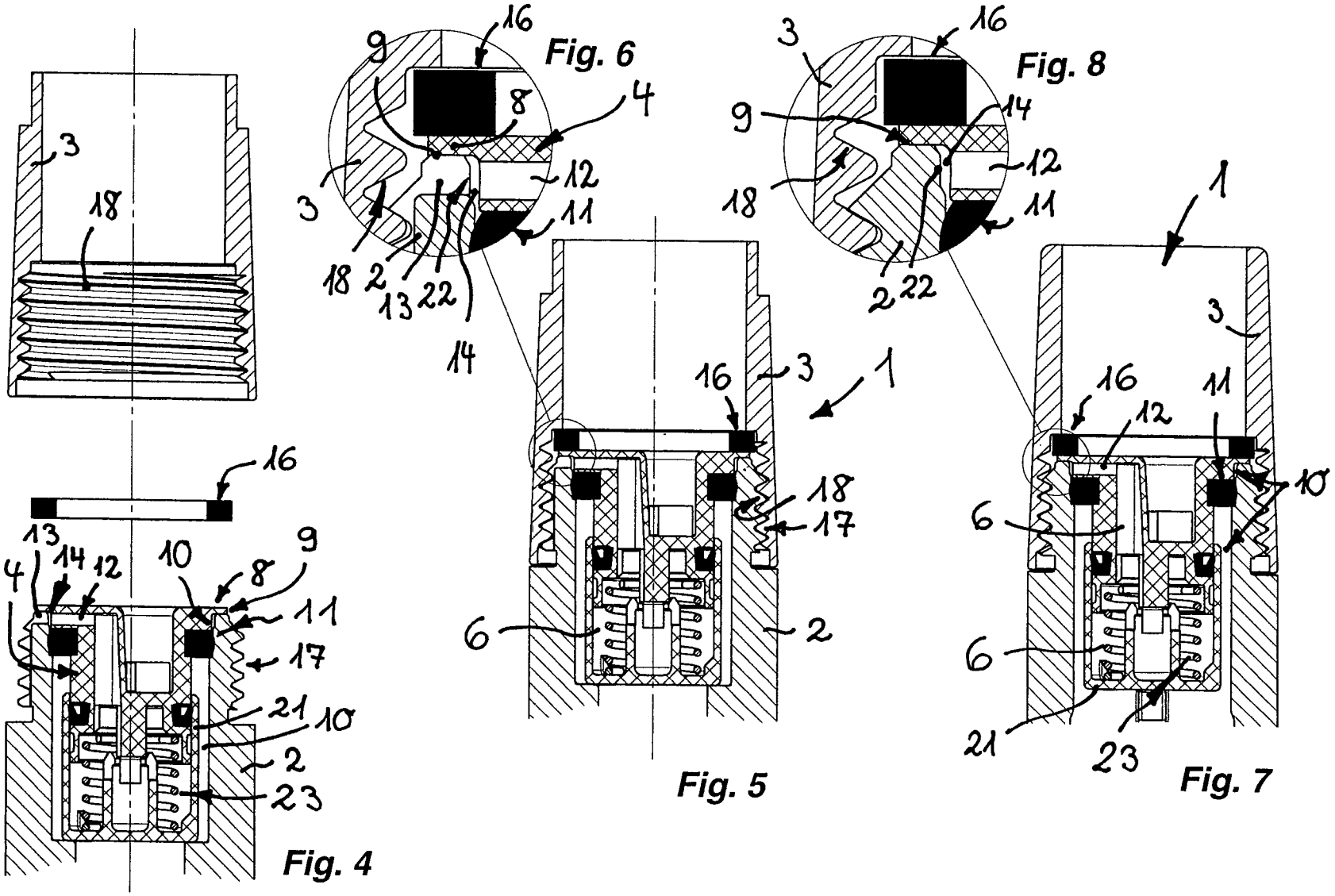
FIG. 4 shows the components of the sanitary coupling that are shown in FIGS. 1 to 3, in a longitudinal section.
FIG. 5 shows the likewise longitudinally sectioned sanitary coupling with its first line section, wherein the second line section which is coupled thereto is also indicated here merely by the union nut, which is held rotatably on the second line section.
FIG. 6 shows the sanitary coupling from FIGS. 1 to 5 in a detailed illustration in the region of the end circumferential edge of the first line section, said end circumferential edge bounding the insert opening, in a detailed longitudinal section in the partial region enclosed in FIG. 5.
FIG. 7 shows the sanitary coupling from FIGS. 1 to 6 in a longitudinal section which is rotated in the circumferential direction in relation to FIGS. 5 and 6.
FIG. 8 shows the hose coupling from FIGS. 1 to 7 in a detailed longitudinal section in the region of the end circumferential edge bounding the insert opening.
Figure 9:
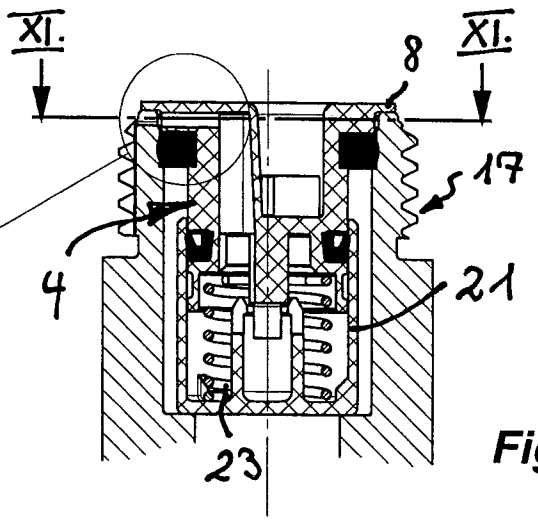
FIG. 9 shows the first line section with the insert element inserted into its housing receptacle, in a longitudinal section.
Figure 11:
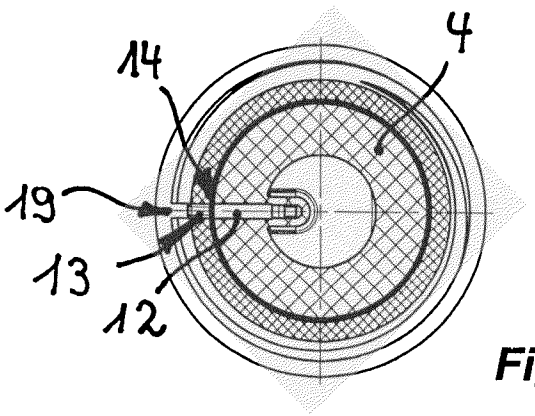
FIG. 11 shows the first line portion with the insert element inserted into its housing receptacle, in a cross section through cross-sectional plane XI/XI from FIG. 9.
Figure 10:
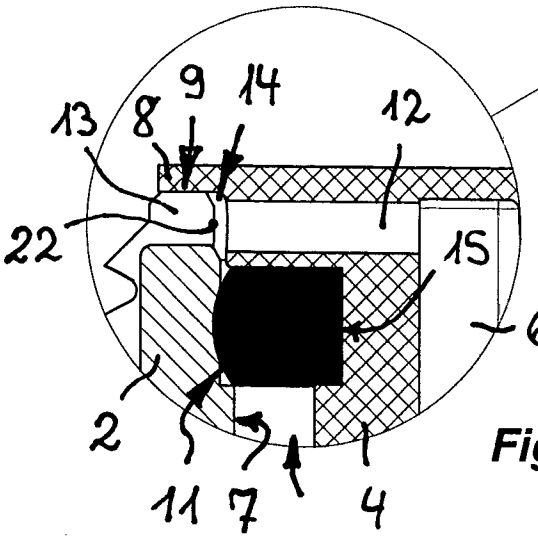
FIG. 10 shows the first line section in a detailed longitudinal section in the partial region, which is enclosed in FIG. 9, between the end circumferential edge bounding the insert opening and the annular flange serving as an insert stop.

FIGS. 1 and 2 illustrate a sanitary coupling 1 which connects an inflow-side and an outflow-side line section to each other. Of said line sections, FIGS. 1 and 2 show only a first line section 2, while the second line section which is connected thereto is indicated only by a union nut 3. This union nut 3 is held rotatably on the second line section (not illustrated further here), but axially immovably in the direction of the first line section 2. For this purpose, an annular flange or annular step serving as a stop can be provided on the second line section, said annular flange or annular step interacting with a counter stop on the inner circumference of the sleeve-shaped union nut 3, said counter stop reaching behind said stop and likewise being designed, for example, as an annular step or annular flange.

The coupling 1 illustrated here can be used, for example, in order to connect a hand-held shower or similar point of water consumption, on the one hand, to a water connection, on the other hand, wherein an insert housing 4, which is designed as an insert cartridge, of a sanitary insert element 5, the housing interior 6 of which insert housing has to communicate with the ambient air, is inserted in one of the line sections and here in the first line section 2. The insert housing 4, the housing interior 6 of which is intended to communicate with the ambient air, is inserted via an end-side insert opening into a housing receptacle 7 of the first line section 2, wherein said first line section 2 can be inflow-side line section or, better—as here—the outflow-side line section. The insert housing 4 is insertable into said first line section 2 until an annular flange 8, which serves as an insert stop, on the insert housing 4, acts upon an end circumferential edge 9 of the first line section 2, said end circumferential edge bounding the insert opening.

So that the housing interior 6 of the insert housing 4 can communicate with the ambient air, an annular zone 10 between the housing outer circumference of the insert housing 4 and the inner circumference of the housing receptacle 7 is sealed radially by at least one annular seal 11. This annular seal 11, which is designed here as a sealing ring which is held in a holding groove 15 on the outer circumference of the insert housing 4, is arranged at a distance from the annular flange 8. In the partial region of the annular zone 10, which partial region is arranged between the annular flange 8 and the at least one annular seal 11, at least one air duct 12 is provided which is effective between the housing interior 6 and the housing outer circumference of the insert housing 4.

The first line section 2 having the housing receptacle 7 has at least one air slot 13 which is designed to be open towards the end circumferential edge 9 bounding the insert opening and towards the inner circumference and towards the outer circumference of the first line section 2. Furthermore, an air gap 14 which connects the at least one air duct 12 to the at least one air slot 13 is provided between the housing outer circumference of the insert housing 4 and the inner circumference of the housing receptacle 7. The ambient air can therefore communicate with the housing interior 6 of the insert housing 4 via the at least one air slot 13, the at least one air duct 12 and the air gap 14 provided therebetween. Since the air duct 12 and the air slot 13 are connected via the air gap 14, which is oriented in the circumferential direction and is encircling here, particular alignment of the insert element 5 and of the first line section 2 having the housing receptacle 7 is not required. A secure and fixed connection of the line sections is not impaired although the ambient air can readily communicate via the air duct 12, the air gap 14 and the air slot 13.

It can be seen in FIGS. 2 to 7 that the second line section is sealed axially in relation to the annular flange 8. For this purpose, a sealing ring 16 is provided between the annular flange 8 and the adjacent end circumferential edge (not illustrated further here) of the second line section.

It is possible for the inflow-side and the outflow-side line section to be connected to each other by a bayonet connection. By contrast, the preferred embodiment illustrated here makes provision for the inflow-side and the outflow-side line section to be connected to each other by a screw connection. For this purpose, an external thread 17 is provided on the outer circumferential side of the one line section 2, which external thread interacts with an internal thread 18 in the union nut 3 assigned to the second line section.

In the exemplary embodiment shown here, the external thread 17 is provided on the first line section 2 while, by contrast, the union nut 3 is held rotatably on the second line section (not shown further here). In the exemplary embodiment shown here, the first line section 2 is the outflow-side line section while the second line section is intended to be the inflow-side line section.

It becomes clear from a comparison of FIGS. 2 to 10 that the air slot 13 merges into a longitudinal groove 19 on the outer circumference of the first line section 2, which longitudinal groove 19 passes through the external thread 17 in the axial direction.

The longitudinal groove 19 extends over the end circumferential edge of the union nut 3, said end circumferential edge facing away from the second line section. In addition or instead, it can be advantageous if the longitudinal groove 19 extends over the entire longitudinal extent of the external thread 17 and—as here—preferably even goes beyond the thread pitch 20 which faces away from the end circumferential edge 9 of the first line section 2.

The insert element 5 is designed here as a pressure limiter which opposes a, for example, pressure-induced temperature increase on the outflow side and therefore in the first line section 2. For this purpose, the insert housing 4 has a cup-shaped piston 21 which engages over the insert housing 4 and, in the event of a pressure increase on the outflow side and therefore in the first line section 2, can be pressed in the direction of the inert housing 4 counter to the resetting force of a resetting or compression spring 23 effective between piston 21 and insert housing 4. By the piston 21 being pushed in during a pressure increase in the first line section 2, a change in volume takes place in the insert housing 4, said change in volume being substantially facilitated if the housing interior 6 of the insert housing 4 can communicate with the ambient air. Over and beyond the use example which is illustrated here and in which the housing interior 6 of the insert housing 4 communicates with the ambient air in order to bring about a pressure equalisation in the volume-variable housing interior 6 of the insert housing 4, the functioning principle according to the invention of the coupling 1 can also be used in order to suck ambient air into the housing interior 6 of the insert housing 4 of an insert element 3.

It becomes clear from a comparison of FIGS. 4 to 8 that the air gap 14 is formed by a recess or an annular groove 22 on the inner circumference of the housing receptacle 7, said annular groove being open towards the insert housing 4 and towards the end circumferential edge 9. The first line portion 2 can also be designed as a hand-held-shower handle, as a fitting connection or as an overhead shower. So that the insert element 5 which is inserted into said first line section can communicate with the ambient air, the at least one air duct 12, the at least one air slot 13 and the air gap 14 are provided which replace complicated bores or holes on the sanitary coupling 1, which holes can only be produced in the case of an injection-moulded part by the use of a complicated slide tool or by subsequent working steps. A particular advantage of the coupling 1 which is illustrated here is that it requires only a comparatively small size, as a result of which the installations in the region of said coupling 1 can turn out to be smaller.

LIST OF REFERENCE SIGNS

1 Sanitary coupling
2 First line section
3 Union nut
4 Insert housing
5 Insert element
6 Housing interior
7 Housing receptacle
8 Annular flange
9 End circumferential edge
10 Annular zone
11 Annular seal
12 Air duct
13 Air slot
14 Air gap
15 Holding grove
16 Sealing ring
17 External thread
18 Internal thread
19 Longitudinal groove
20 Thread pitch
21 Piston
22 Annular groove
23 Resetting or compression spring

The invention claimed is:

1. A sanitary coupling (1) for connecting an inflow-side and an outflow-side line section to each other, the sanitary coupling comprising:

a first line section (2) with a housing receptacle (7), a sanitary insert element (5) having an insert housing (4) designed as an insert cartridge, said insert housing (4) is inserted via an end-side insert opening into the housing receptacle (7) in the first line section (2) until an annular flange (8), which serves as an insert stop, on the insert housing (4) acts upon an end circumferential edge (9) of the first line section (2), said end circumferential edge bounding the end-side insert opening, the insert housing (4) has a housing interior (6) which communicates with ambient air, an annular zone (10) is provided between a housing outer circumference of the insert housing (4) and an inner circumference of the housing receptacle (7), which in a partial region, has at least one air duct (12) having an inner end that connects to the housing interior (6) and an outer end that extends to the housing outer circumference to provide an air flow path therebetween, and in the partial region of the annular zone (10) that is arranged between the annular flange (8) and at least one annular seal (11), an air gap (14) is arranged between the housing outer circumference and the inner circumference of the housing receptacle (7), the housing interior (6) of the insert housing (4) is a volume-variable housing interior, the first line section (2) having the housing receptacle (7) including at least one air slot (13) which is open towards the end circumferential edge (9) of the first line section (2) and towards the inner circumference and towards an outer circumference of the first line portion (2), the air gap (14) connects the at least one air duct (12) to the at least one air slot (13) such that the volume-variable housing interior communicates with ambient air in order to bring about pressure equalization in the volume-variable housing interior (6) of the insert housing (4), a second line section, wherein the first line section and the second line section are connected to each other by a screw connection or a bayonet connection, wherein an external thread (17) is provided on an outer circumferential side of the first line section (2), said external thread interacts with an internal thread (18) in a union nut (3), said union nut (3) is held on the second line section, and wherein the at least one air slot (13) merges into a longitudinal groove (19) on the outer circumference of the first line section (2), said longitudinal groove (19) passes through the external thread (17) in an axial direction.

2. The sanitary coupling according to claim 1, wherein the at least one annular seal (11) is arranged at a distance from the annular flange (8) and radially seals the annular zone (10).

3. The sanitary coupling according to claim 1, wherein the at least one annular seal (11) comprises a sealing ring which is held in a holding groove (15) on the housing outer circumference of the insert housing (4).

4. The sanitary coupling according to claim 1, further comprising a seal (16) between the annular flange (8) and an adjacent end circumferential edge of the second line section.

5. The sanitary coupling according to claim 1, wherein the first line section (2) is the outflow-side line section and the second line section is the inflow-side line section.

6. The sanitary coupling according to claim 1, wherein the longitudinal groove (19) extends over an end circumferential edge of the union nut (3), said end circumferential edge faces away from the second line section.

7. The sanitary coupling according to claim 1, wherein the longitudinal groove (19) extends over an entire longitudinal extent of the external thread (17).

8. The sanitary coupling according to claim 1, wherein the air gap (14) is formed by at least one of an annular groove (22), a recess or an annular gap on the housing outer circumference of the insert housing (4) or on an inner circumference of the housing receptacle (7) of the first line section (2).

9. The sanitary coupling according to claim 7, wherein the longitudinal groove (19) extends over the entire longitudinal extent of the external thread (17) and beyond a thread pitch (20) facing away from the end circumferential edge (9) of the first line section (2).

* * * * *